US007325993B2

(12) United States Patent
Gueret

(10) Patent No.: US 7,325,993 B2
(45) Date of Patent: Feb. 5, 2008

(54) DEVICE FOR PACKAGING AND APPLYING SUBSTANCE, AND METHOD OF MANUFACTURING DEVICE

(75) Inventor: Jean-Louis H. Gueret, Paris (FR)

(73) Assignee: L'Oréal S.A. (FR)

( * ) Notice: Subject to any disclaimer, the term of this patent is extended or adjusted under 35 U.S.C. 154(b) by 396 days.

(21) Appl. No.: 10/956,137

(22) Filed: Oct. 4, 2004

(65) Prior Publication Data

US 2005/0102978 A1 May 19, 2005

Related U.S. Application Data

(60) Provisional application No. 60/511,319, filed on Oct. 16, 2003.

(30) Foreign Application Priority Data

Oct. 2, 2003 (FR) ..... 03 11543

(51) Int. Cl.

| | |
|---|---|
| ***B43K 5/00*** | (2006.01) |
| ***A46B 5/02*** | (2006.01) |
| ***A46B 11/00*** | (2006.01) |
| ***A47L 1/08*** | (2006.01) |

(52) U.S. Cl. ..... 401/202; 401/126; 401/190; 401/23

(58) Field of Classification Search ..... 401/123, 401/126, 205, 206, 202, 207, 270, 277, 190, 401/183, 184, 23

See application file for complete search history.

(56) References Cited

U.S. PATENT DOCUMENTS 3,264,676 A 8/1966 Schwartzman
4,548,524 A 10/1985 Seager
6,305,863 B1 10/2001 Gueret
6,503,016 B2 * 1/2003 Raps et al. ..... 401/198

(Continued)

FOREIGN PATENT DOCUMENTS

CH 185 011 6/1936

(Continued)

OTHER PUBLICATIONS

European Search Report issued Jan. 20, 2005, by the European Patent Office in EP 04 30 0649.

(Continued)

*Primary Examiner*—David J. Walczak
(74) *Attorney, Agent, or Firm*—Finnegan, Henderson, Farabow, Garrett & Dunner, L.L.P.

(57) ABSTRACT

A device for packaging and applying a substance may include a receptacle including a body defining a first space and an opening. The first space may be configured to receive a supply of the substance. The receptacle may include a second space and a partition. The partition may have at least one orifice formed therein configured to provide flow communication between the first space and the second space. The device may include a first closure member configured to close the opening of the body, the first closure member being mounted on the body, an applicator at least partially disposed in the second space, and a second closure member configured to be removably mounted on the receptacle such that the second space is closed except for the orifice in the partition.

47 Claims, 4 Drawing Sheets

U.S. PATENT DOCUMENTS

| | | | |
|---|---|---|---|
| 6,648,538 | B2 | 11/2003 | Gueret |
| 2001/0031168 | A1 | 10/2001 | Gueret |
| 2002/0048481 | A1 | 4/2002 | Gueret |
| 2002/0172541 | A1 | 11/2002 | Gueret |
| 2003/0086742 | A1 | 5/2003 | Gueret |
| 2003/0129016 | A1 | 7/2003 | Gueret |

FOREIGN PATENT DOCUMENTS

| | | |
|---|---|---|
| EP | 1 086 904 | 3/2001 |
| EP | 1 312 280 | 5/2003 |
| FR | 1 142 591 | 9/1957 |
| FR | 2 588 457 | 4/1987 |
| FR | 2 812 277 | 2/2001 |
| FR | 2 800 041 | 4/2001 |
| FR | 2 812 276 | 2/2002 |

OTHER PUBLICATIONS

English language Derwent Abstract of EP 1 086 904, Mar. 28, 2001.
English language Derwent Abstract of FR 2 588 457, Apr. 17, 1987.
English language Derwent Abstract of FR 2 800 041, Apr. 27, 2001.

* cited by examiner

X
1
4
5
6
15
14
13
9
17
16
10
3
8
34
33
35
11
31
63
21
20
36
32

6
44
45
5
4
9
13
3
10
42
42
8
21
11
20

6
9
4
48
42
47
10
8
46
21
20

4
83
17
82
8
10

4
80
17
9
13
84
8
10

DEVICE FOR PACKAGING AND APPLYING SUBSTANCE, AND METHOD OF MANUFACTURING DEVICE

This application claims the benefit of priority under 35 U.S.C. § 119(e) of U.S. provisional application No. 60/511,319, filed on Oct. 16, 2003, the disclosure of which is incorporated herein by reference.

The present invention relates to devices for packaging and applying a substance. For example, the devices for packaging and applying a substance may be used to package and apply cosmetic products, including care products, make-up products, and/or products such as those defined in Counsel Directive 93/35/EEC (European Economic Community) dated Jun. 14, 1993, which provides one non-limiting, exemplary definition of cosmetic products. (Other definitions are also possible.) Such devices may be the type including, for example, a receptacle containing a supply of substance, a receptacle closure member, and an applicator formed of, for example, a porous material (e.g., foam). The applicator may be configured to be arranged relative to the receptacle so as to be in flow communication with the supply of substance. For example, the applicator may be received in a housing of the receptacle that may be in flow communication with the supply of substance.

European patent application EP 1 312 280-A1 describes a device of the type described above, in which the applicator is carried by a support part snap-fastened on the neck of the receptacle.

With a device of that kind, the applicator may be insufficiently filled with substance upon first use, for example, if the substance is relatively viscous and/or if the user fails to shake the receptacle sufficiently beforehand. Thus, the user may believe that the applicator cannot be used for long enough and may consider the device unsatisfactory.

EP 1 312 280-A1 also describes a receptacle formed by a flexible tube having one end carrying the applicator. In that embodiment, insufficient initial loading of the applicator with the substance may not present a problem since the user may be naturally encouraged by the shape of the receptacle to squeeze its wall in order to expel the substance that is to impregnate the applicator.

French patent application FR 2 812 277 describes a device in which the substance can be expelled into a housing containing the applicator by means of a piston driven in displacement (e.g., actuated) by turning a knurled wheel, for example. Such a device presents a structure that is relatively complex.

French patent application FR 2 800 041 describes a device in which the body of the receptacle is provided with an elastomer bottom wall having an outwardly bulging portion on which the user can press (e.g., actuate) in order to raise pressure. That device has means provided to facilitate filling the applicator with substance, which the user can actuate on first use. Nevertheless, the presence of the elastomer bottom wall can lead to constraints concerning the appearance of the device, in particular if it is desired to encourage the user to press thereagainst naturally. In particular, the bulging portion of the bottom wall that is movable relative to the body of the receptacle may be made in such a manner as to project beyond it at rest, which may encourage the user to press thereagainst.

European patent application EP 1 086 904 describes devices in which the applicator support is constituted by a separate part fitted to the body of the receptacle. The presence of such a part may significantly increase the cost of the receptacle. EP 1 086 904 also describes a device in which the body of the receptacle includes a bellows, thereby simultaneously encouraging the user to compress it in order to fill the applicator with substance, such that the above-mentioned problem does not arise. However, the presence of the bellows may complicate manufacture of the receptacle.

In an exemplary embodiment, the present invention may attempt to remedy the problem of the applicator being insufficiently filled with substance on first use, which problem may arise, in particular, when the device does not have any specific means for user actuation to cause the space containing the applicator to be fed with substance upon first use, such as, for example: a knurled wheel for driving a piston, a piston movable relative to the reservoir containing the product to be applied when the device is in an assembled configuration, an elastomer bottom wall, a bellows, a flexible wall, and/or any other type of mechanism configured to be actuated by the user when the device is in an assembled configuration so as to cause an increase in pressure within the reservoir (e.g., space) containing the product. A "piston" as used herein, includes such pistons as described in U.S. Pat. No. 6,305,863, or a pistons having a knurled wheel, as described in US2003/0086742, for example. A piston may be, for example, able to have an axial displacement along a length (e.g., along the longitudinal axis) of the reservoir, such as more than one-half of the length, for example, when the device is in an assembled configuration.

Although the present invention may obviate one or more of the abovementioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for packaging and applying a substance. The device may include a receptacle including a substantially rigid body defining a first space and an opening. The first space may be configured to receive a supply of the substance. The receptacle may include a second space and a partition having at least one orifice formed therein configured to provide flow communication between the first space and the second space. The device may include first substantially rigid closure member configured to close the opening of the body, the first closure member being mounted on the body, an applicator at least partially disposed in the second space, and a second closure member configured to be removably mounted on the receptacle such that the second space is closed except for the orifice in the partition.

The term "substantially rigid body" means a body that does not deform significantly during normal use of the device by the user. For example, a substantially rigid body does not have a zone on which the user applies pressure in order to deform the body in use, such as, for example, a bellows.

Some aspects of the invention may render it possible, for example, to increase the quantity of substance contained in the applicator on first use, thereby improving comfort in application without excessively complicating manufacture of the device or requiring the user to perform a specific prior action on the receptacle.

According to another aspect, the device may include a tubular skirt at least partially defining the second space. The receptacle may be relatively inexpensive to manufacture, for example, since the body thereof may be formed integrally with at least the above-specified partition and/or with the tubular skirt.

In still another aspect, the first closure member and the receptacle body may be configured such that mounting the first rigid closure member on the body while the second closure member is mounted on the body such that the second space is closed except for the orifice in the partition, while the first space contains substance (e.g., the first space is substantially filled with substance), and/or while the receptacle is oriented in an inverted position such that the first space is located above the second space, causes a pressure increase in the first space such that at least a portion of the substance is moved into the second space so as to at least partially load the applicator with substance. It may thus be possible to increase the quantity of substance present on the applicator on first use independently of any pressure exerted by and/or action performed by the user. The rigid body may need not be significantly deformed by the extra pressure created in this manner.

In yet another aspect, the first closure member may include a sealing member bearing against an inside surface of the receptacle body. For example, the sealing member may include an annular sealing lip. Furthermore, during mounting of the first closure member to the receptacle body, the sealing member and the receptacle body may be configured such that the sealing member bears in a substantially leaktight manner against an inside surface of the receptacle body before the first closure member reaches its mounted position (e.g., its position in the final assembled state of the device.) The first sealing member and the inside surface of the receptacle body may come into contact along either substantially the entire height of the sealing lip during mounting to the body, or on only a portion thereof.

According to yet another aspect, the first closure member may be mounted in a non-removable manner to the receptacle body such that the first closure member is not moveable relative to the receptacle body when in the mounted position. The term "in a non-removable manner" should be understood as meaning that the first closure member is not intended to be moved by the user in order to cause the applicator to be filled with substance.

In another aspect, the first closure member may be snap-fastened to the receptacle body. In still another aspect, the first closure member may be fastened to the receptacle body via adhesive. According to yet a further aspect, the first closure member may be fastened to the receptacle body via heat-sealing. In still a further aspect, the first closure member may be fastened to the receptacle body via ultrasound.

According to some aspects, the first closure member may be removably fastened to the receptacle body. For example, the first closure member may be threaded onto the receptacle body. The term "removably fastened" should be understood as meaning that the first closure member is intended and configured to be optionally separated from the body by the user during normal operation of the device. When the first closure member is removable, the first closure member may, for example, include a second applicator member (e.g., a second porous applicator member (e.g., formed from a foam)).

In still another aspect, the first closure member may include a housing configured to receive a separate element, for example, a label and/or a mirror.

According to yet another aspect, the receptacle may have a bottom wall and the first closure member may form only the bottom wall of the receptacle.

In yet another aspect, the first rigid closure member may include a skirt at least partially covering an exterior portion of the receptacle body. For example, the skirt may cover substantially the entire receptacle body.

In still a further aspect, the device may include an end piece fitted in the opening of the receptacle body and defining a housing, the housing being configured to receive a second applicator. For example, the first closure member and the end piece may be configured such that the first closure member can be removably fastened to the end piece.

According to still another aspect, the first closure member may be in direct contact with the receptacle body. In yet another aspect, the first closure member may be mounted to the receptacle body such that the first closure member is able to contact the substance.

In yet a further aspect, the receptacle body may define a length and a cross-section, and the cross-section may increase along a major portion of the receptacle body length in the direction of the opening. Such a configuration may form draft for facilitating unmolding of the receptacle. According to another aspect, the receptacle body may define a cross-section and a length, and the cross-section may remain substantially constant along a major portion of the receptacle body length.

In yet another aspect, the first rigid closure member may be circularly symmetrical-shaped, which may render it easier to mount the first closure member to the receptacle body, for example, without previously identifying an angular position of the first closure member relative to the body of the receptacle.

According to still a further aspect, the tubular skirt may include at least one portion, the at least one portion and the second closure member may be configured such that the second closure member can be fastened to the at least one portion. For example, the at least one portion may include, in relief, a thread, configured to fasten the second closure member to the tubular skirt.

In yet another aspect, the applicator may be secured to the second closure member. In still a further aspect, the receptacle may include a tubular skirt at least partially defining the second space and an inside chimney having an end fastened to the applicator, and the second closure member may include an outer skirt configured to be fastened to the tubular skirt of the receptacle. In a further aspect, the partition may be configured to support (e.g., provide a seat for) the applicator. In yet another aspect, the applicator may be secured to the receptacle body. For example, the receptacle body may be integrally formed with a chimney opening out to the applicator (e.g., the chimney may be integrally formed with the partition).

According to some aspects, the annular sealing lip may have a height of at least about 3 millimeters. In other aspects, the annular sealing lip may have a height of at least about 5 millimeters.

According to yet another aspect, the annular sealing lip may contact the receptacle body in a substantially leaktight manner along a portion of the a height of the receptacle body extending from about 3 millimeters to about 14 millimeters.

In yet another aspect, the receptacle body and the first rigid closure member may be configured to generate an increase in pressure in the first space ranging from about 10 millibar to about 400 millibar when the first rigid closure member is mounted on the receptacle body.

According to some aspects, the receptacle may be configured in a wide variety of shapes, for example, including a neck defining at least part of the second space configured to contain the applicator. In some aspects, the receptacle body may be configured to define a variety of cross-sections. For example, the receptacle body may be configured to define a cross-section that is substantially circular, for example, in order to render it easier to mount the first closure member to the receptacle. In some aspects, the receptacle body may be configured to define a cross-section that is not circular, for example, a cross-section that is at least one of polygonal (e.g., square, rectangular, or triangular), elliptical, oval, and lenticular (e.g., lens-shaped).

According to another aspect, the receptacle body may be formed from at least one material selected from plastics and glass.

In still other aspects, the applicator may include a porous material, for example, a foam, which may be at least one of an open-celled foam or a semi-open-celled foam, for example. In some aspects, the applicator may include at least one of a felt and a sintered part, for example, a sintered part made of thermoplastic material and/or of ceramic material.

According to some aspects, the substance contained in the receptacle may be a liquid, for example, a liquid for application to the body (e.g., a lotion for body care and/or a sun screen).

In still another aspect, a device for packaging and applying a substance may include a receptacle including a substantially rigid body defining a first space and an opening, the first space being configured to receive a supply of a substance. The receptacle may further include a second space, and a partition defining at least one orifice configured to provide flow communication between the first space and the second space. The device may further include a first substantially rigid closure member configured to close the opening of the body, the first rigid closure member being mounted to the body and an applicator at least partially disposed in the second space. The device also may include a second closure member configured to be removably fastened to the receptacle such that the second space is substantially closed except for the orifice in the partition. The first closure member and the receptacle body may be configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. The first closure member may not be a piston.

According to yet another aspect, a device for packaging and applying a substance including a receptacle including a substantially rigid body defining a first space and an opening, the first space being configured to receive a supply of substance. The receptacle may further include a second space, and a partition integrally-formed with the body via molding of a material, the partition defining at least one orifice configured to provide flow communication between the first space and the second space. The device may also include a first substantially rigid closure member configured to close the opening of the body, the first closure member being mounted to the body, and an applicator at least partially disposed in the second space. In addition, the device may include a second closure member configured to be removably fastened to the receptacle such that the second space is substantially closed except for the orifice in the partition. The first closure member and the receptacle body may be configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. An axial position of the first closure member relative to the receptacle may not depend on the amount of substance contained in the first space.

According to another aspect, a device for packaging and applying a substance may include a receptacle including a substantially rigid body defining a first space and an opening, the first space being configured to receive a supply of the substance. The receptacle may further include a second space, and a partition integrally-formed with the body via molding of a material, the partition defining at least one orifice configured to provide flow communication between the first space and the second space. The device may further include a first substantially rigid closure member configured to close the opening of the body, the first rigid closure member being mounted to the body and an applicator at least partially disposed in the second space. Additionally, the device may include a second closure member configured to be removably fastened to the receptacle such that the second space is substantially closed except for the orifice in the partition. The first closure member and the receptacle body may be configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. The first space and the second space may be in permanent flow communication with one another.

In still another aspect, a device for packaging and applying a substance may include a receptacle including a substantially rigid body defining a first space and an opening, the first space being configured to receive a supply of the substance. The receptacle may also include a second space and a partition defining at least one orifice configured to provide flow communication between the first space and the second space. The device may further include a first substantially rigid closure member configured to close the opening of the body, the first rigid closure member being mounted to the body, and an applicator at least partially disposed in the second space. Additionally, the device may include a second closure member configured to be removably fastened to the receptacle such that the second space is substantially closed except for the orifice in the partition. The first closure member and the receptacle body may be configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. The first closure member and the receptacle may be configured such that the first closure member axially abuts the receptacle when it is mounted on the receptacle.

According to another aspect, a device for packaging and applying a substance may include a receptacle including a body defining a first space and an opening, the first space being configured to receive a supply of substance. The receptacle may also include a second space and a partition defining at least one orifice configured to provide flow communication between the first space and the second space. The device may include a first closure member configured to close the opening of the body, the first closure member being mounted to the body and an applicator at least partially disposed in the second space. Additionally, the device may include a second closure member configured to be removably fastened on the receptacle such that the second space is substantially closed except for the orifice in the partition. The first closure member and the receptacle body may be configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. According to an aspect, the first closure member may not be associated with an applicator and may be mounted on the body via at least one of snap-fastening and threading.

In still a further aspect, a device may include a receptacle including a body containing a supply of substance. The body may include a neck defining an inside space, a partition including at least one orifice, the partition being configured to separate the inside space from the substance, and a bottom end defining a peripheral portion. The neck and partition may be integrally formed with the body. The device may include an applicator at least partially housed the neck and a capsule mounted on the peripheral portion of the bottom end of the receptacle body via at least one of heat-sealing and adhesive.

According to some aspects, the collar may include a rim at its periphery, and the rim may define a thickness greater than or equal to a thickness of the capsule. The capsule may render it possible to avoid using a closure member that may be complex and/or more expensive. According to some aspects, the capsule may be formed via one of a film and a label.

Yet another aspect includes a device for applying a substance, the device may include a receptacle including a body defining a first space and an opening, the first space being configured to receive a supply of substance. The receptacle may further include a second space and a partition separating the first space from the second space, the partition defining at least one orifice providing flow communication between the first space and the second space. The device may further include a first closure member configured to be mounted to the body proximate the opening and an applicator disposed at least partially in the second space. The device may further include a second closure member configured to be removably fastened to the receptacle so as to close the second space except for the orifice in the partition. The first closure member and the receptacle body may be configured such that mounting the first closure member on the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance. According to an aspect, the first closure member may be nonactuatable to further cause substance to move into the second space once mounted to the receptacle body.

In yet another aspect, a device for applying a substance may include a receptacle including a body defining a first space configured to receive a supply of substance, a second space, and a partition separating the first space from the second space, the partition defining at least one orifice providing flow communication between the first space and the second space. The device also may include a first closure member configured to be mounted to a first end of the body closer to the first space than to the second space and an applicator disposed at least partially in the second space. The device may further include a second closure member configured to be removably fastened to the receptacle so as to close the second space except for the orifice in the partition. The first closure member and the receptacle body may be configured such that mounting the first closure member on the body while the second closure member is fastened to the receptacle, the first space contains substance, and the receptacle is oriented in an inverted position such that the first space is located above the second space, causes a pressure increase in the first space such that at least a portion of the substance is moved into the second space so as to at least partially load the applicator with substance. According to an aspect, once mounted to the body, the first closure member may not be moveable in an axial direction along the body toward the applicator.

According to yet a further aspect, a method of manufacturing a device for packaging and applying a substance wherein the device includes a receptacle including a body defining a first space defining an opening at a first end of the body, a second space located at a second end of the body opposite from the first end, and an applicator housed in the second space, may include placing the receptacle in a filler station such that the second space is oriented below the first space. The method may further include passing substance through the opening so as to at least partially fill the first space and mounting a first closure member to the receptacle body such that pressure within the receptacle is increased so as to move at least a portion of the substance toward the applicator.

In still another aspect, the receptacle body may be integrally formed with a partition separating the first space from the second space, wherein the partition includes at least one orifice configured to place the first space in fluid communication with the second space.

According to another aspect, the first closure member may be mounted to the receptacle body via at least one of snap-fastening, threading, gluing, and welding.

In still a further aspect, the first closure member may be displaced in a substantially leaktight manner relative to the receptacle body along a distance of at least about 3 millimeters to generate the increase in pressure.

In yet another aspect, the first closure member may be displaced in a substantially leaktight manner relative to the receptacle body along a distance of at least about 5 millimeters to generate the increase in pressure.

According to some aspects, the increase in pressure may range from about 10 millibar to and about 400 millibar.

In still a further aspect, the first space and the second space may be in permanent flow communication with one another.

In yet another aspect, the first closure member differs from a piston.

In some aspects, the receptacle body may be formed integrally with a partition separating the first space and the second space, and may include at least one orifice configured to provide flow communication between the first space and the second space, and a tubular skirt may at least partially define the second space.

According to some aspects, a device for packaging and applying a substance, for example, a cosmetic product, may include a receptacle including a body and a first space inside the body configured to receive a supply of substance, the body defining at least one opening at a bottom end of the body, the body defining at least in its bottom end a cross-section that may be substantially constant or that may flare downwards. The body may include a top portion having a tubular skirt formed integrally with the body via molding a material, the tubular skirt at least partially defining a second space distinct from the first space, the second space being configured to communicate with the first space. The device may include a first closure member fitted in the opening, the first closure member being either fastened in a non-removable manner on the body of the receptacle without it being possible to move it relative to the body of the receptacle, or fastened in a removable manner on the body of the receptacle and including a second applicator. The device may include an applicator including a porous material, the applicator being at least partially disposed in the second space. The device may include a second closure member configured to be fastened in a removable manner on the receptacle, for example, in order to close the second space.

In still another aspect, a device for packaging and applying a substance, for example, a cosmetic product, may include a receptacle including a rigid body defining a first space located inside the body for receiving a supply of substance, a second space distinct from the first space, and a partition including at least one orifice configured to place the second space in flow communication with the first space. The device may include a first closure member configured to close an opening of the body and to be mounted on the body. The first closure member may be either fixed in a non-removable manner to the body of the receptacle, for example, without it being possible to move it relative to the body of the receptacle, or the first closure member may be mounted in a removable manner to the body of the receptacle. The device may include an applicator at least partially disposed in the second space, and a second closure member configured to be mounted in a removable manner on the receptacle, for example, in order to close the second space.

According to yet a further aspect, the partition may be integrally formed with the body. For example, the partition may be integrally formed with the body via molding of a material.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic, partial section view of an embodiment of a device for packaging and applying a substance;

Reference will now be made in detail to some possible embodiments of the invention, examples of which are illustrated in the accompanying drawings. Wherever possible, the same reference numbers are used in the drawings and the description to refer to the same or like parts.

Figure 1:
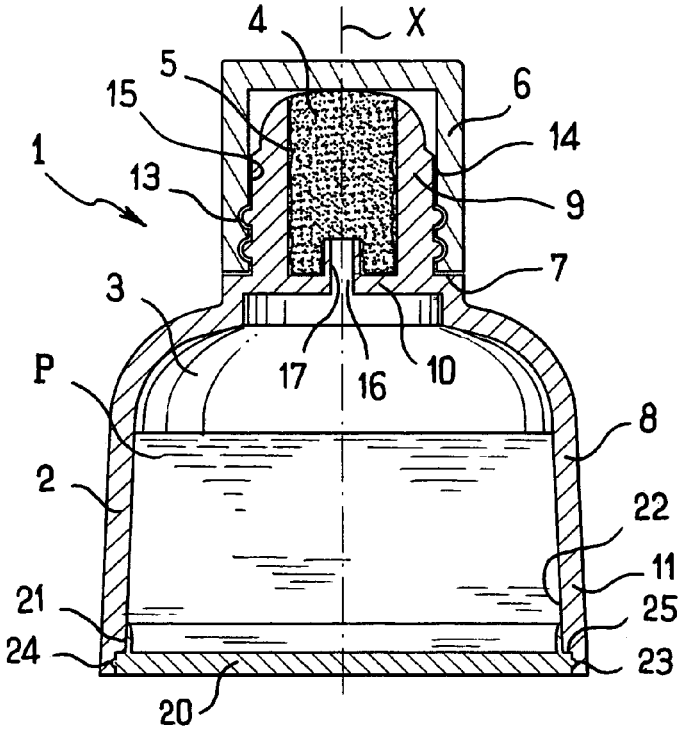

The exemplary device 1 for packaging and applying a substance shown in FIG. 1 may include a receptacle 2 having a longitudinal axis X, with a body 8 defining a first space 3 (e.g., reservoir) containing a liquid P (e.g., a substance for makeup purposes and/or for care purposes, and/or for protecting the body and/or the face.) For example, the substance may be for application to the skin (e.g., including the mucous membranes) and/or to the hair.

The device 1 may also include an applicator 4 contained in a second space 5 of the receptacle 2, and may be defined laterally by a tubular skirt 9 of axis X. For example, the applicator 4 may be porous and/or compressible, for example, the applicator 4 may be formed from a compressible foam, such as, for example, an open-celled foam. In the example shown, the applicator 4 lies substantially totally outside the first space 3, for example, when the device 1 is closed.

The body 8 of the exemplary device 1 described with reference to FIG. 1, may be formed as a single piece, for example, via injection molding a thermoplastic material to form the skirt 9 and a partition 10, which may separate the first space 3 and second space 5 from one another. The body 8 may be formed from, for example, a material, and/or formed, for example, having a wall thickness, configured for substantially ensuring the body has a sufficient degree of rigidity. As shown in FIG. 1, for example, the wall of the body 8 may be circularly symmetrical about the longitudinal axis X, and may extend axially substantially from the bottom end of the device 1 to as far as the partition 10 (e.g., over more than half the total height of the device 1 as shown in FIG. 1).

Figure 2:
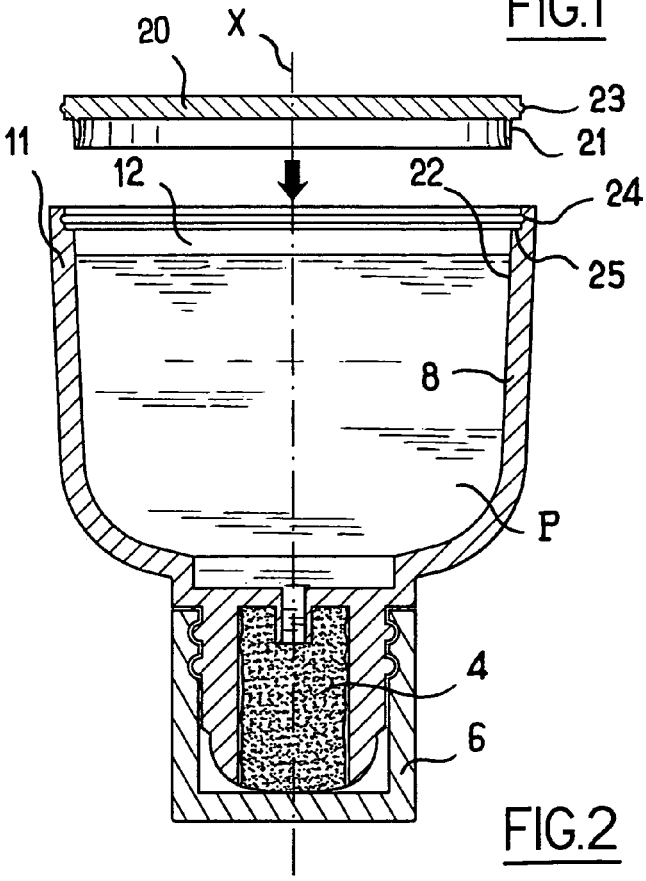
FIG. 2 is a schematic, partial section view of one configuration of the device of FIG. 1 in an inverted orientation prior to assembly.

In the exemplary embodiment shown in FIG. 1, the skirt 9 may be connected via a shoulder 7 to the body 8, and the skirt 9 may form the neck of the receptacle 2. In its bottom portion 11, the body 8 may include an opening 12 (e.g., as shown in FIG. 2), and a first closure member 20 may be mountable relative to the opening 12. As shown in FIG. 1, for example, the skirt 9 may be formed with threading 13 on its outside surface configured to threadingly engage a second closure member 6. The second closure member 6 may include, for example, a surface 14 that may be configured to be pressed in a substantially leaktight manner against a corresponding surface 15 of the skirt 9, for example, so as to obtain a substantially leaktight closure of the receptacle 2 in its top portion.

According to some exemplary embodiments, the second closure member 6 may include other sealing structures, for example, an annular lip distinct from the skirt 9 engageable with the threading 13. For example, the annular lip may press in a substantially leaktight manner against the inside surface of the skirt 9.

In the exemplary embodiment shown in FIG. 1, the partition 10 extends substantially perpendicularly to the axis X, although the partition 10 may extend at other angles.

In the exemplary embodiment of device 1 shown in FIGS. 1 and 2, the body 8 of the receptacle 2 may be formed integrally with a chimney 17 having its base connected to the partition 10 and defining an inside channel 16 on the axis X, through which the substance contained in the receptacle 2 can reach the applicator 4, thereby enabling flow communication between the first space 3 and the second space 5, for example, permanent flow communication.

In the exemplary embodiment of device 1 shown in FIGS. 1 and 2, the first closure member 20 may include an annular sealing lip 21, which bears in a substantially leaktight manner against the inner surface 22 (e.g., a radial inner surface) of the bottom portion 11 of the body 8. The height of the lip 21 may, for example, range from about 3 millimeters to about 14 millimeters, for example, the lip height may be at least about 5 millimeters. According to an exemplary embodiment, the first closure member 20 may be snap-fastened on the body 8, and may include a portion in relief, such as, for example, an annular bead 23 configured to engage a corresponding annular groove 24 of the body 8. The bottom portion 11 of the receptacle 2 may include a shoulder 25, for example, serving as an abutment for the first closure member 20. Such an abutment may serve as an obstacle to movement of the first closure member 20 along the length (longitudinal axis X) of the body 8 in a direction toward the applicator 4.

According to some exemplary embodiments, after the body 8 has been molded with the skirt 9 and the partition 10, the applicator 4 may be fastened in the space 5 (e.g., via adhesive, heat-sealing, a tight fit, and/or via another type of fastener element (not shown)) (e.g., fitted onto the skirt 9). Thereafter the second closure member 6 may be mounted and the receptacle 2 may be inverted. The receptacle 2 may thereafter be substantially filled with the substance P, for example, as shown in FIG. 2. The first closure member 20 can thereafter be mounted (e.g., snapped as shown in FIG. 2) onto the body 8. While the first closure member 20 is being put into place, for example, the annular sealing lip 21 may press against the inside surface 22 of the body 8 before the first closure member 20 has finished its downward stroke to complete assembly of the device 1, such that an increase in pressure may be created in the first space 3. The increase in pressure may urge (e.g., expel) substance P toward the applicator 4, which may thus become at least partially loaded, for example, substantially loaded, with a quantity of substance P that may be greater than would be the case, for example, if the first closure member 20 had been mounted on the receptacle 2 with the pressure in the first space 3 remaining substantially constant inside the receptacle 2. The shape of the first closure member 20 may be be selected as a function, for example, of the volume of air expected to be present over the substance P while the first closure member 20 is mounted, as a function of the nature of the substance, and/or as a function of the nature of the applicator 4.

The increase in pressure generated by the reduction of the internal volume of the body 8 during engagement of the first closure member 20 may range from about 10 millibar to about 400 millibar, for example, from about 50 millibar to about 350 millibar, for example, from about 100 millibar to about 300 millibar. According to some embodiments, upon first using the device for applying substance, a user may be provided with an applicator that can be used for a longer period of time.

According to some embodiments, relatively tight contact between the first closure member 20 and the body 8 may occur substantially all along displacement of the first closure member 20 as it is assembled into position relative to the body 8, for example, along at least 3 millimeters of the displacement.

Figure 3:
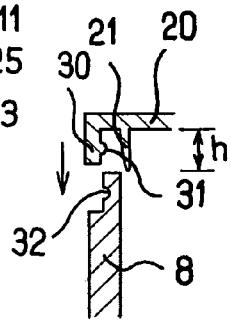
FIG. 3 is a schematic, partial section view of one embodiment of a portion of a device for packaging and applying a substance.

Once the first closure member 20 has been fastened, such as in a non-removable manner to the body 8, for example, as shown in FIG. 3, the receptacle 2 may be turned upright from an inverted orientation (e.g., as shown in FIG. 2), and may be packaged in, for example, a box (e.g., a cardboard box) in conventional manner. The term fastened "in a non-removable manner" should be understood as meaning that under normal circumstances, something fastened in a non-removable manner cannot be removed by a user, for example, at least not without damaging the first closure member 20, for example, by using one or more tools. In other words, in the assembled form of device 1, when the first closure member 20 is fastened "in a non-removable manner," it is not intended to be removed by users of the device for applying substance.

However, the invention is not limited to one particular method of fastening the first closure member 20 to the body 8, and the first closure member 20 may be fastened in a removable manner as well, e.g., wherein the first closure member 20 is intended to be removed by a user of the device 1. For example, the first closure member 20 may include a rim 30 at its periphery (as shown in FIG. 3), the rim 30 including an annular bead 31 on its radially inner surface that may be configured to snap into an annular groove 32 into the body 8 of the receptacle 2. According to some exemplary embodiments, the first closure member 20 may include a sealing lip 21 (e.g., an annular sealing lip), for example, as shown in FIG. 1. The sealing lip 21 may be substantially concentric with the rim 30. The sealing lip 21 may create a relative tightness over a height ranging from about 3 millimeters to about 15 millimeters (e.g., from about 5 millimeters to about 12 millimeters (e.g., from about 8 millimeters to about 10 millimeters)). The tight contact may be created at the beginning and/or during the snap-fastening and/or the threading, and until the complete fastening. The contact may be created over the whole and/or over part of the height h of the sealing lip 21.

Figure 4:
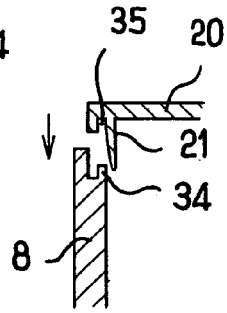
FIG. 4 is a schematic, partial section view of another embodiment of a portion of a device for packaging and applying a substance.

In the exemplary embodiment of FIG. 4, the receptacle body 8 may be formed with an annular rib 34 configured to engage a corresponding groove 35 formed in the first closure member 20, the first closure member 20 and the body 8 being assembled together via adhesive, heat-sealing, ultrasound sealing, and/or other suitable securing mechanism, for example, after the rib 34 has been engaged in the groove 35. According to some embodiments, the groove 35 may be radially adjacent to the sealing lip 21.

Figure 5:
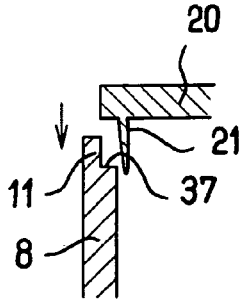
FIG. 5 is a schematic, partial section view of a further embodiment of a portion of a device for packaging and applying a substance.

In the exemplary embodiment of FIG. 5, the first closure member 20 and the body 8 may be assembled together via heat-sealing, the bottom portion 11 of the receptacle 2 including, for example, a shoulder 37 against which the first closure member 20 may come to bear, for example, while it is being mounted on the body 8.

Figure 6:
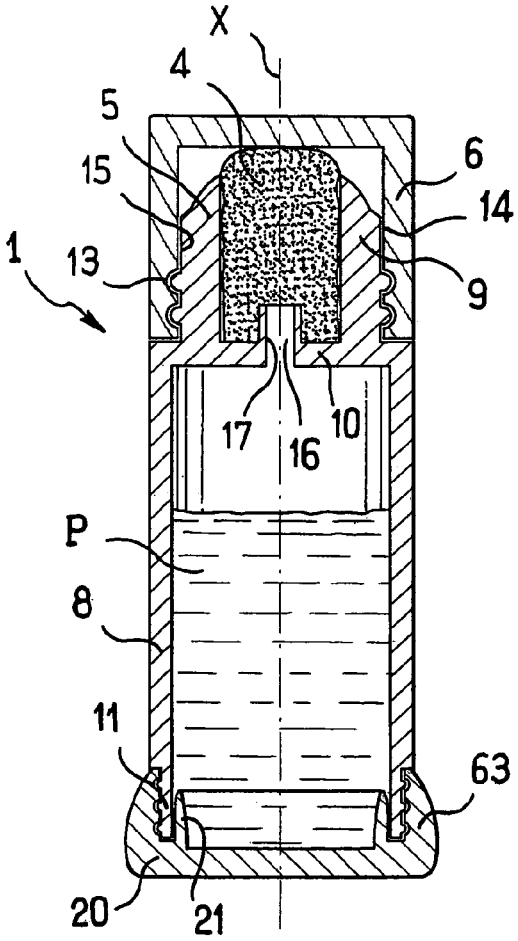
FIG. 6 is a schematic, partial section view of an embodiment of a device for packaging and applying a substance.

FIG. 6 shows an exemplary embodiment in which the first closure member 20 is configured to be mounted on the receptacle body 8 in removable manner. For example, the first closure member 20 may include a threaded outer skirt configured to be threaded onto the bottom portion 11 of the receptacle 2. According to some embodiments, the first closure member 20 may be removably mounted onto the receptacle body 8 via snap-fastening. FIG. 6 shows that the receptacle body 8 may be formed with an inside cross-section that is constant over substantially its entire height, and shows an embodiment of first closure member 20 that may include a peripheral portion 63 projecting from the receptacle body 8.

Figure 7:
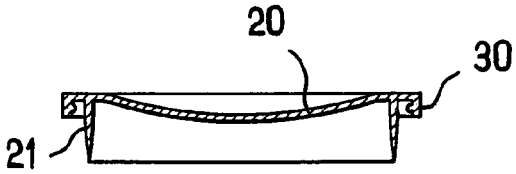
FIG. 7 is a schematic, partial section view of an embodiment of a portion of a device for packaging and applying a substance.

According to some embodiments, the first closure member 20 may be formed with an outwardly concave outside face, for example, in its central portion, as shown in FIG. 7.

Figure 8:
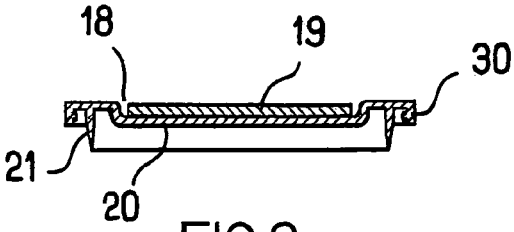
FIG. 8 is a schematic, partial section view of another embodiment of a portion of a device for packaging and applying a substance.

According to some embodiments, the first closure member 20 may also be formed with a setback 18, as shown in FIG. 8, serving, for example, to receive an element 19 that may be substantially flat in configuration, for example, a label, a mirror, and/or other ornamental feature.

According to some embodiments, the first closure member 20 may be formed with an outside face whose central region is substantially planar and perpendicular to the axis X (e.g., rendering it possible for the receptacle 2 to stand vertically on a horizontal, planar surface).

In the exemplary embodiments depicted in FIGS. 1 through 8, the first closure member 20 may be fastened directly to the receptacle body 8, and may form a bottom wall of the receptacle body 8.

Figures 9, 10, 11, 13, 14:
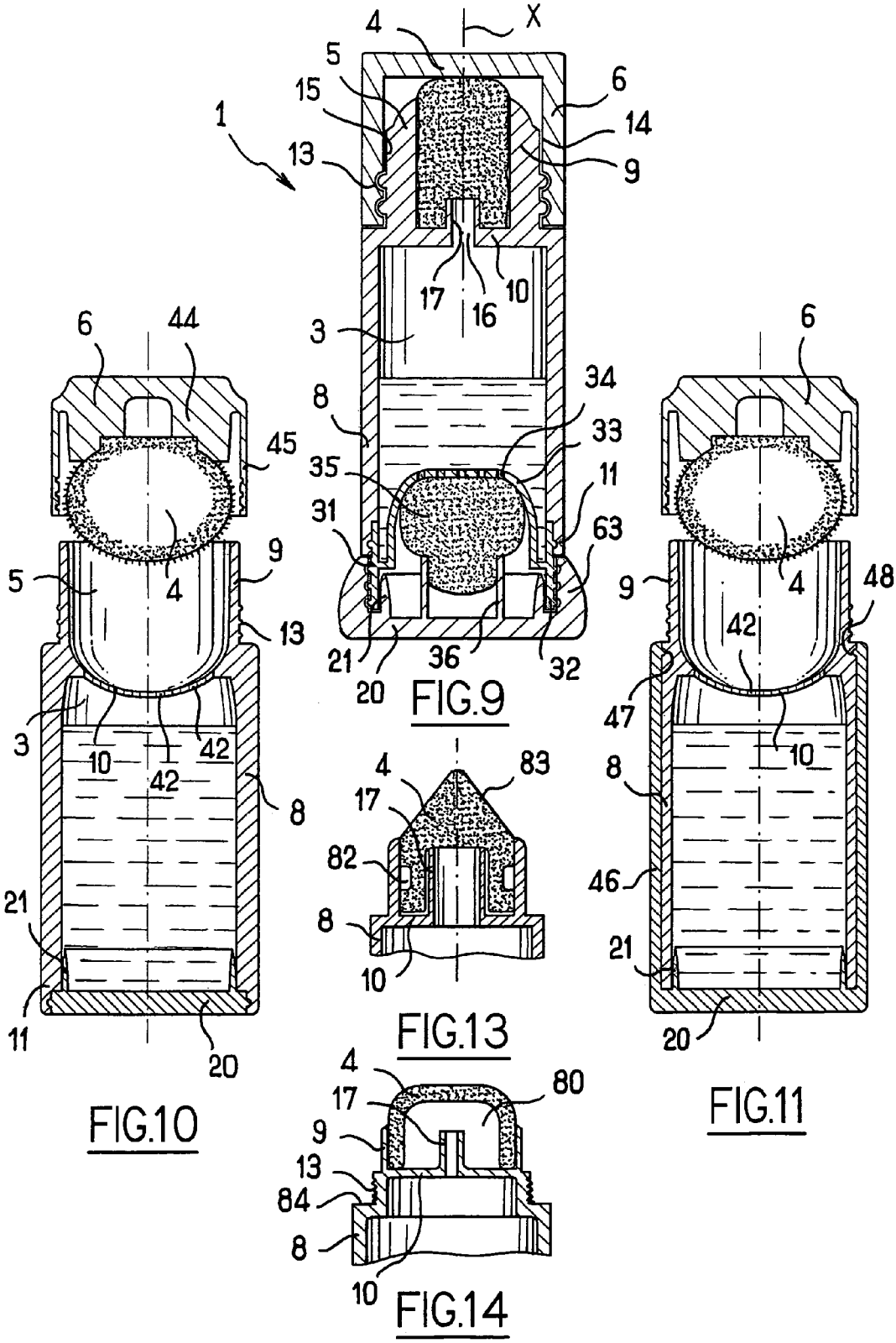
FIG. 9 is a schematic, partial section view of an embodiment of a device for packaging and applying a substance.
FIG. 10 is a schematic, partial section view of another embodiment of a device for packaging and applying a substance.
FIG. 11 is a schematic, partial section view of a further embodiment of a device for packaging and applying a substance.
FIG. 13 is a schematic, partial section view of an embodiment of a portion of a device for packaging and applying a substance.
FIG. 14 is a schematic, partial section view of another embodiment of a portion of a device for packaging and applying a substance.

According to some embodiments, as shown in FIG. 9, for example, the first closure member 20 may be mounted on the receptacle body 8 via an end piece 31 configured to be fastened to the bottom portion 11 of the receptacle body 8 (e.g., via at least one of snap-fastening, heat-sealing, adhesive, ultrasonic sealing, and/or other securing mechanism). The first closure member 20 may include, for example, a skirt 32 having an outside threading for cooperating with a corresponding structure on the bottom portion 11 of the receptacle body 8. For example, the end piece 31 may include a wall 33 having one or more orifices 34 therein serving as a seat for a second applicator 35, which may be secured to the first closure member 20.

In the exemplary embodiment shown in FIG. 9, the second applicator 35 may be formed from a foam, and the first closure member 20 may include a chimney 36 having the second applicator 35 fastened thereto.

According to some embodiments, while the first closure member 20 is being fastened to the end piece 31, the annular sealing lip 21 may bear against the inside face of the skirt 32, so that an increase in pressure is created inside the first space 3 while the first closure member 20 is being threaded thereon. According to some embodiments, the first closure member 20 may be mounted at substantially the same time as the end piece 31, for example, by pre-mounting the first closure member 20 on the end piece 31.

In the exemplary embodiment of FIGS. 1 and 2, the applicator 4 may be secured to the receptacle 2, but it would not go beyond the ambit of the present invention for the applicator 4 to be secured to the second closure member 6, for example, as shown in FIG. 10. In the exemplary embodiment described with reference to FIG. 10, the applicator 4 may remain substantially completely outside the first space 3 when the device 1 is closed. For example, the applicator 4 may be neither squeezed nor wiped by the partition 10.

According to some embodiments, the second space 5 may be partially defined by the partition 10, which may act as a seat for the applicator 4 and which may be configured in a shape that is generally concave towards the applicator 4. The partition 10 may have one or more orifices 42 such that the first space 3 and second space 5 may communicate with one another. For example, the applicator 4 may be fastened to the end of a chimney 44 of the second closure member 6, the chimney 44 being substantially surrounded by an outer skirt 45 configured to be threaded onto the threading 13.

In the exemplary embodiment shown in FIG. 11, the first closure member 20 covers more than the bottom end portion of the receptacle 2. In this embodiment, the closure member 20 has at its periphery an outer skirt 46 substantially covering at least a fraction along the length of the body 8, for example, extending, as shown in FIG. 11, substantially the entire height of the body 8 (e.g., up to the base of the skirt 9), so as to substantially cover the receptacle 2. According to some embodiments, the outer skirt 46 may contribute to making the receptacle substantially leaktight and to generating an increase in pressure in the receptacle 2 while the first closure member 20 is being mounted on the receptacle 2. The outer skirt 46 can include a top portion having (e.g., in relief) an annular bead 47 configured to snap into a complementary relief (e.g., an annular groove 48) in the receptacle body 8.

Figure 12:
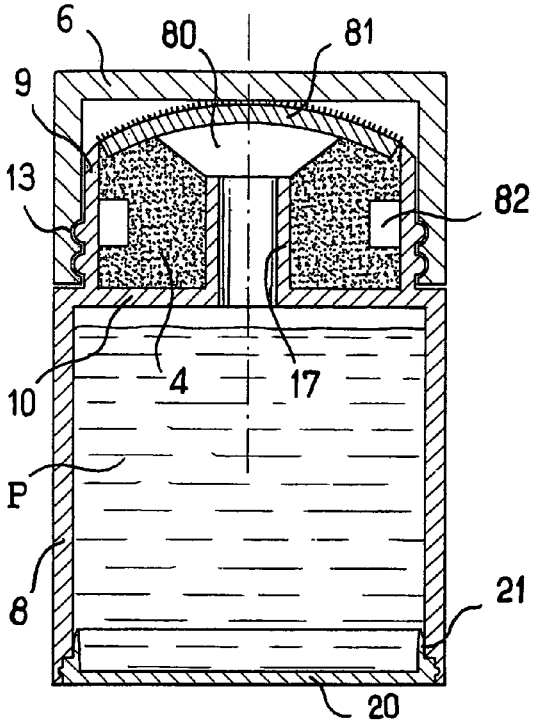
FIG. 12 is a schematic, partial section view of another embodiment of a device for packaging and applying a substance.

The applicator 4 can be formed in various, numerous ways without going beyond the ambit of the present invention. For example, when the applicator 4 is permanently fastened to the receptacle 2, the applicator 4 may include a chamber 80, for example, as shown in FIG. 12, with a chimney 17 opening out therein. The chamber 80 may be separated from the exterior by a membrane 81 that may be flocked on its exterior and may be formed from a foam and/or any other porous material.

According to some embodiments, for example, as shown in FIG. 13, the applicator 4 may include a peripheral groove 82 for imparting a degree of flexibility during application.

Figure 15:
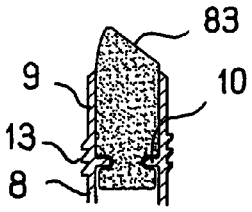
FIG. 15 is a schematic partial, section view of a further embodiment of a portion of a device for packaging and applying a substance.

FIGS. 13 through 15 show other exemplary embodiments of applicators 4. Applicator 4 may be configured to have an application surface 83 that is generally tapered in shape, for example, it may be frustoconical-shaped. In the exemplary embodiment depicted in FIG. 14, a threading 13 may be formed on the body 8 (e.g., above a shoulder 84 thereof).

In the exemplary embodiment shown in FIG. 15, the applicator 4 is configured with an application surface 83 that is generally chamfered. The skirt 9 may be formed to have substantially the same outside diameter as the body 8, with the body 8 being generally in the form of a pen, for example.

Figure 16:
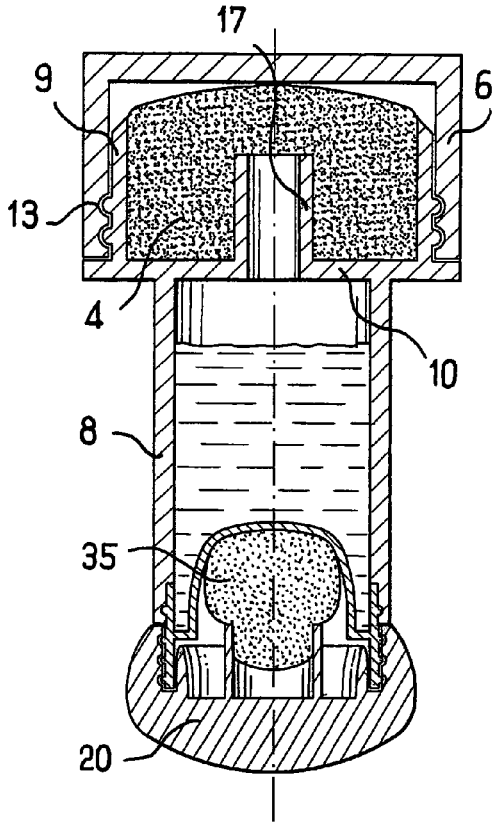
FIG. 16 is a schematic, partial section view of an embodiment of a device for packaging and applying a substance.

The receptacle 2 may also be configured in a variety of shapes. For example, in the exemplary embodiment shown in FIG. 16, the receptacle 2 is configured with a relatively wide head, and the applicator 4 is configured to have an application surface area that is greater than that of the second applicator 35.

Figure 17:
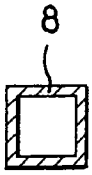
FIG. 17 is a schematic cross-section view of a portion of an embodiment of a device for packaging and applying a substance.
Figure 18:
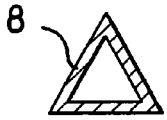
FIG. 18 is a schematic cross-section view of a portion of another embodiment of a device for packaging and applying a substance.
Figure 19:
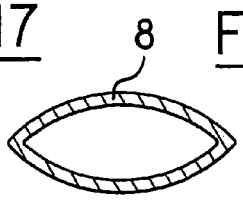
FIG. 19 is a schematic cross-section view of a portion of a further embodiment of a device for packaging and applying a substance.

The receptacle 2 may not be circularly symmetrical in shape. For example, its cross-section may be polygonal (e.g., rectangular or square) as shown in FIG. 17, and/or triangular (as shown in FIG. 18), and/or its cross-section may be oblong in shape (e.g., oval-shaped, elliptical, and/or lenticular (lens-shaped) as shown in FIG. 19).

Figure 20:
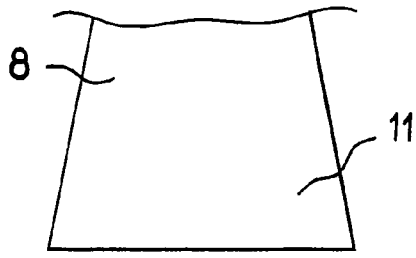
FIG. 20 is a schematic view of a portion of an embodiment of a device for packaging and applying a substance.

The body 8 may be configured to have a bottom portion that flares downward (e.g., as shown in FIG. 20).

Figure 21:
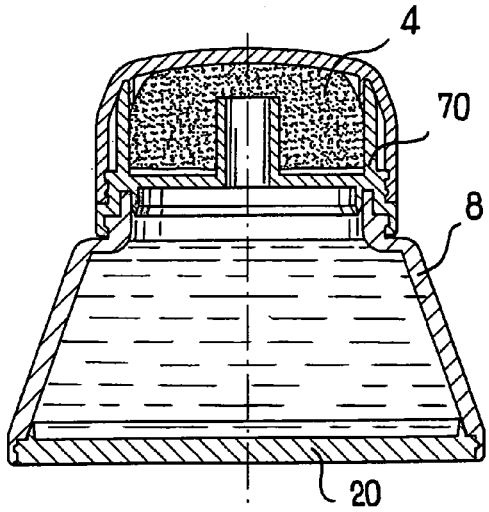
FIG. 21 is a schematic, partial section view of an embodiment of a device for packaging and applying a substance.

According to some embodiments, the device 1 may include other configurations and/or aspects. For example, according to some embodiments of methods associated with the invention, an increase in pressure in the receptacle, for example, at the time of adding a quantity of substance to the receptacle, at which time the applicator 4 may become at least partially loaded with substance, for example, prior to a user's first use, may be implemented with a receptacle (e.g., the receptacle of the exemplary embodiment of device shown in FIG. 21), where the applicator 4 may be fastened to a support piece 70, which may or may not be integrally formed with the body 8 of the receptacle, but which may be mounted thereon (e.g., fitted thereto).

Figure 22:
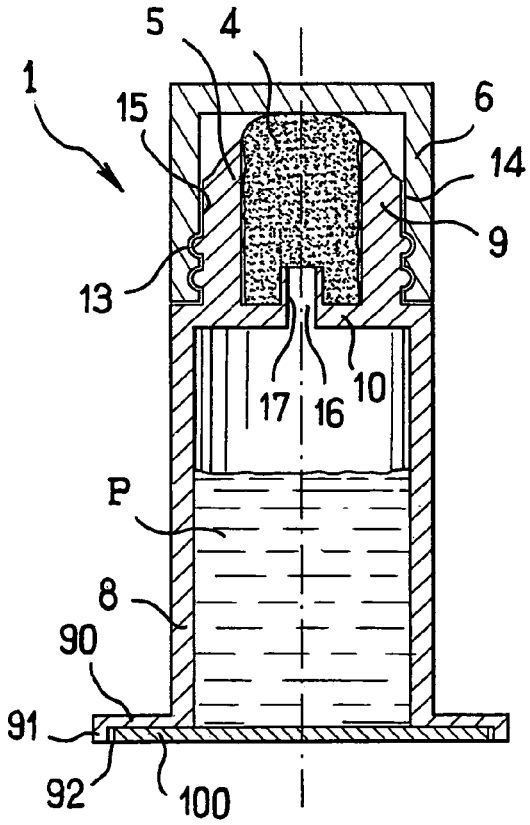
FIG. 22 is a schematic, partial section view of another embodiment of a device for packaging and applying a substance.

FIG. 22 shows an exemplary embodiment of a device 1 that may be relatively inexpensive to make. In this exemplary embodiment, the body 8 of the receptacle may be configured with a collar 90 at its bottom end that may be terminated by a downwardly-directed rim 91, defining a housing 92 for receiving a capsule 100. The capsule 100 may include an element that is relatively flat in shape, for example, a film and/or a label that may be heat-sealed and/or adhesively secured to the collar 90.

The device according to some exemplary embodiments of the invention may be used to apply cosmetic products and/or care products, such as make-up products, dermatological substances, and/or pharmaceutical compositions used for treating and/or changing the appearance and/or scent of a surface, such as a keratinous surface and/or skin, for example. However, in its broadest aspects, the present invention could be used to apply many other types of substances to many other types of surfaces.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for packaging and applying a substance, the device comprising:

a receptacle comprising a substantially rigid body defining a first space and an opening, the first space being configured to receive a supply of a substance, a second space, and a partition defining at least one orifice configured to provide flow communication between the first space and the second space;

a first substantially rigid closure member configured to close the opening of the body, the first rigid closure member being mounted to the body;

an applicator at least partially disposed in the second space; and a second closure member configured to be removably fastened to the receptacle such that the second space is substantially closed except for the orifice in the partition, wherein the first closure member and the receptacle body are configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance, and wherein the first closure member is not a piston.

2. The device of claim 1, further comprising a tubular skirt at least partially defining the second space.

3. The device of claim 2, wherein the tubular skirt comprises at least one portion, the at least one portion and the second closure member being configured such that the second closure member can be fastened to the at least one portion.

4. The device of claim 1, wherein the first rigid closure member comprises a sealing member bearing against an inside surface of the receptacle body.

5. The device of claim 4, wherein the sealing member comprises an annular sealing lip.

6. The device of claim 5, wherein the annular sealing lip has a height of at least about 3 millimeters.

7. The device of claim 5, wherein the annular sealing lip has a height of at least about 5 millimeters.

8. The device of claim 5, wherein the annular sealing lip contacts the receptacle body in a substantially leaktight manner along a portion of a length of the receptacle body extending from about 3 millimeters to about 14 millimeters.

9. The device of claim 4, wherein, during mounting of the first rigid closure member to tile receptacle body, the sealing member and the receptacle body are configured such that the sealing member bears in a substantially leaktight manner against an inside surface of the receptacle body before the first rigid closure member reaches its mounted position.

10. The device of claim 1, wherein the first rigid closure member is mounted in a non-removable manner to the receptacle body and is not moveable relative to the receptacle body when in the mounted position.

11. The device of claim 10, wherein the first closure member is snap-fastened to the receptacle body.

12. The device of claim 10, wherein the first closure member is mounted to the receptacle body via adhesive.

13. The device of claim 10, wherein the first closure member is mounted to the receptacle body via heat-sealing.

14. The device of claim 10, wherein the first closure member is mounted to the receptacle body via ultrasound.

15. The device according to claim 1, wherein the first closure member is removably mounted to the receptacle body.

16. The device of claim 15, wherein the first closure member is threaded onto the receptacle body.

17. The device of claim 1, wherein the first closure member comprises a housing configured to receive a separate element.

18. The device of claim 1, wherein the first closure member comprises a skirt at least partially covering an exterior portion of the receptacle body.

19. The device of claim 18, wherein the first closure member and the end piece are configured such that the first closure member can be removably fastened to the end piece.

20. The device of claim 18, wherein the skirt covers substantially the entire receptacle body.

21. The device of claim 1, further comprising an end piece fitted in the opening of the receptacle body and defining a housing, the housing being configured to receive a second applicator.

22. The device of claim 1, wherein the first closure member is in direct contact with the receptacle body.

23. The device of claim 1, wherein the first closure member is mounted to the receptacle body such that the first closure member is able to contact the substance.

24. The device of claim 1, wherein the receptacle body defines a length and a cross-section, and the cross-section increases along a major portion of the receptacle body length in the direction of the opening.

25. The device of claim 1, wherein the receptacle body defines a cross-section and a length, and the cross-section remains substantially constant along a major portion of the receptacle body length.

26. The device of claim 1, wherein the receptacle comprises a bottom wall, and first closure member forms a bottom of the receptacle.

27. The device of claim 1, wherein the first closure member is circularly symmetrical.

28. The device of claim 1, wherein the applicator is secured to the second closure member.

29. The device of claim 28, wherein the receptacle comprises a tubular skirt at least partially defining the second space and an inside chimney having an end fastened to the applicator, and wherein the second closure member comprises an outer skirt configured to be fastened to the tubular skirt of the receptacle.

30. The device of claim 28, wherein the partition is configured to support the applicator.

31. The device of claim 1, wherein the applicator is secured to the receptacle body.

32. The device of claim 31, wherein the receptacle body is integrally formed with a chimney opening out to the applicator.

33. The device of claim 32, wherein the chimney is integrally formed with the partition.

34. The device of claim 1, wherein the pressure increase ranges from about 10 millibar to about 400 millibar.

35. A method of manufacturing the device of claim 1 the method comprising:

placing the receptacle in a filler station such that the second space is oriented below the first space;

passing substance through the opening so as to at least partially fill the first space; and mounting a first closure member to the receptacle body such that pressure within the receptacle is increased so as to move at least a portion of the substance toward the applicator.

36. The method of claim 35, wherein the receptacle body is integrally formed with a partition separating the first space from the second space, wherein the partition comprises at least one orifice configured to place the first space in fluid communication with the second space.

37. The method of claim 35, wherein mounting the first closure member includes at least one of snap-fastening, threading, gluing, and welding the first closure member to the receptacle body.

38. The method of claim 35, wherein mounting the first closure member includes moving the first closure member in a substantially leaktight manner relative to the receptacle body along a distance of at least about 3 millimeters to generate the pressure increase.

39. The method of claim 35, wherein mounting the first closure member includes moving the first closure member in a substantially leaktight manner relative to the receptacle body along a distance of at least about 5 millimeters to generate the pressure increase.

40. The method of claim 35, wherein the pressure increase ranges from about 10 millibar to and about 400 millibar.

41. The method of claim 35, wherein the first space and the second space are in permanent flow communication with one another.

42. The method of claim 35, wherein the first closure member does not act as a piston in the mounted position.

43. A device for packaging and applying a substance, the device comprising:

a receptacle comprising a substantially rigid body defining a first space and an opening, the first space being configured to receive a supply of substance, a second space, and a partition defining at least one orifice configured to provide flow communication between the first space and the second space;

a first substantially rigid closure member configured to close the opening of the body, the first closure member being mounted to the body;

an applicator at least partially disposed in the second space; and a second closure member configured to be removably fastened to the receptacle such that the second space is substantially closed except for the orifice in the partition, wherein the first closure member and the receptacle body are configured such that mounting the first closure member to the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance, and wherein an axial position of the first closure member relative to the receptacle does not depend on the amount of substance contained in the first space.

44. The device of claim 43, wherein the partition is integrally formed with the body via molding of a material.

45. A device for applying a substance, the device comprising:

a receptacle comprising a body defining a first space and an opening, the first space being configured to receive a supply of substance, a second space, and a partition separating the first space from the second space, the partition defining at least one orifice providing flow communication between the first space and the second space;

a first closure member configured to be mounted to the body proximate the opening;

an applicator disposed at least partially in the second space; and a second closure member configured to be removably fastened to the receptacle so as to close the second space except for the orifice in the partition, wherein the first closure member and the receptacle body are configured such that mounting the first closure member on the body while the second closure member is fastened to the body, the first space contains substance, and the receptacle is oriented in an inverted position such that the first space is located above the second space, causes a pressure increase in the first space such that at least a portion of the substance is moved into the second space so as to at least partially load the applicator with substance, and wherein the first closure member is nonactuatable to further cause substance to move into the second space once mounted to the receptacle body.

46. A device for applying a substance, the device comprising:

a receptacle comprising a body defining a first space configured to receive a supply of substance, a second space, and a partition separating the first space from the second space, the partition defining at least one orifice providing flow communication between the first space and the second space;

a first closure member configured to be mounted to a first end of the body closer to the first space than to the second space;

an applicator disposed at least partially in the second space; and a second closure member configured to be removably fastened to the receptacle so as to close the second space except for the orifice in the partition, wherein the first closure member and the receptacle body are configured such that mounting the first closure member on the body while the second closure member is fastened to the receptacle, the first space contains substance and the receptacle is oriented in an inverted position such that the first space is located above the second space, causes a pressure increase in the first space such that at least a portion of the substance is moved into the second space so as to at least partially load the applicator with substance, and wherein, once mounted to the body, the first closure member is not moveable in an axial direction along the body toward the applicator.

47. The device of claim 1, wherein the partition is integrally formed with the body via molding of a material.

* * * * *

UNITED STATES PATENT AND TRADEMARK OFFICE

CERTIFICATE OF CORRECTION

PATENT NO. : 7,325,993 B2
APPLICATION NO. : 10/956137
DATED : February 5, 2008
INVENTOR(S) : Jean-Louis H. Gueret It is certified that error appears in the above-identified patent and that said Letters Patent is hereby corrected as shown below:

In claim 9, column 16, line 55, “tile” should read --the--.

In claim 35, column 17, line 62, “claim 1” should read --claim 1,--.

In claim 40, column 18, line 26, “to and about” should read --to about--.

Signed and Sealed this

Third Day of June, 2008

JON W. DUDAS
*Director of the United States Patent and Trademark Office*